US011970912B2

(12) United States Patent
Magali

(10) Patent No.: US 11,970,912 B2
(45) Date of Patent: Apr. 30, 2024

(54) TUBULAR DRIVE ASSEMBLY

(71) Applicant: Shachar Magali, Drimmelen (NL)

(72) Inventor: Shachar Magali, Drimmelen (NL)

( * ) Notice: Subject to any disclaimer, the term of this patent is extended or adjusted under 35 U.S.C. 154(b) by 69 days.

(21) Appl. No.: 17/619,418

(22) PCT Filed: Jun. 16, 2020

(86) PCT No.: PCT/NL2020/000011
§ 371 (c)(1),
(2) Date: Dec. 15, 2021

(87) PCT Pub. No.: WO2020/256538
PCT Pub. Date: Dec. 24, 2020

(65) Prior Publication Data

US 2022/0290508 A1 Sep. 15, 2022

(30) Foreign Application Priority Data

Jun. 17, 2019 (NL) ..... 1043302

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS 1,895,901 A 1/1933 Smith
5,263,899 A 11/1993 Nozaki et al.
5,368,083 A 11/1994 Beck
5,501,287 A * 3/1996 Loeser ..... E21B 17/07 175/203
5,630,477 A 5/1997 Minatre
5,746,277 A 5/1998 Howell, Jr.
10,890,033 B1 * 1/2021 Crosby ..... E21B 17/00
2001/0048854 A1 * 12/2001 Carter, Jr. ..... E02D 5/46 52/742.16
2004/0158831 A1 9/2004 Nozaki et al.
2004/0173383 A1 * 9/2004 Hollingsworth ..... E21B 10/64 175/323

(Continued)

OTHER PUBLICATIONS

International Search Report and Written Opinion from Application No. PCT/NL2020/000011 dated Jan. 9, 2020.

*Primary Examiner* — Taras P Bemko
(74) *Attorney, Agent, or Firm* — Troutman Pepper Hamilton Sanders LLP; Ryan A. Schneider; Dustin B. Weeks

(57) ABSTRACT

A tubular drive assembly including two or more polygonal tubes one inside the other. While being rotational loaded, to at least one direction, the tubular drive assembly delivers torque to that direction, maintains straightness, prevents lateral movements between the two said tubes, and allows longitudinal force as much as the friction between the tubes. The tubes may be provided with mutually cooperating coupling members for providing mutual fixation in longitudinal direction. Mutual rotation of two successive tubes in one direction will bring the coupling members into engagement to prevent relative longitudinal displacement. Mutual rotation in the opposite direction will disengage the coupling members to allow relative longitudinal displacement.

22 Claims, 10 Drawing Sheets

(56) References Cited

U.S. PATENT DOCUMENTS

| | | | | |
|---|---|---|---|---|
| 2011/0048805 | A1* | 3/2011 | Bauer | E02D 7/22 175/57 |
| 2011/0105235 | A1* | 5/2011 | Krollmann | E21B 17/07 464/92 |
| 2012/0186882 | A1* | 7/2012 | Biserna | E21B 7/023 175/220 |
| 2015/0008040 | A1* | 1/2015 | Wiedenmann | E21B 7/00 175/57 |
| 2017/0191313 | A1* | 7/2017 | Biserna | E21B 7/02 |
| 2017/0284162 | A1* | 10/2017 | Schober | E21B 17/07 |
| 2022/0220814 | A1* | 7/2022 | Bauer | E21B 17/07 |

* cited by examiner

TUBULAR DRIVE ASSEMBLY

FIELD OF THE INVENTION

The present invention relates in general to a tubular drive assembly such as for instance used in Kelly-bars. Kelly-bars are for instance, but not exclusively, applied in foundation, ground drilling, rock drilling, exploration drilling, and slurry wall. For sake of convenience, in the following the tubular drive assembly itself will also be indicated as "Kelly bar", and pairs of tubes in the assembly will also be indicated as "Kelly pair".

BACKGROUND OF THE INVENTION

The following illustrate examples of applications for Kelly-bars of various types:

| US PATENTS DOCUMENTS | | | |
|---|---|---|---|
| 6,000,477 | Dec. 14, 1999 | Campling et al. | Elastomer accelerated hammer |
| 1,895,901 | Jan. 31, 1933 | H. R. Smith | Kelly-Bar |
| 3,757,876 | Sep. 11, 1973 | Pereau | Drilling and blasting apparatus |
| 3,987,856 | Oct. 26, 1976 | Carl et al | Kelly crowd for vertical drill rig |
| 4,877,091 | Oct. 31, 1089 | Howell Jr. | Augering apparatus and drilling rig |
| 5,263,899 | Nov. 23, 1993 | Nozaki et al. | Cylindrical telescopic kelly-bar apparatus |
| 5,368,083 | Nov. 29, 1994 | Beck, III | Telescopic kelly-bar apparatus and method |
| 5,501,287 | Mar. 26, 1996 | Loeser | Drilling device with telescopic kelly-bar. |
| 5,593,603 | Jan. 14, 1997 | Sajatovic | Method for producing hardened flutes in a kelly-bar |
| US 2004/0173383 A1 - Sep. 9, 2004 - Hollingworth Apparatus and method for rotary bored drilling | | | |

The common kelly-bar is an assembly of two or more modified round tubes, one inside the other. For each assembly of two tubes, the inner one has a number of longitudinal steel strips welded on the external perimeter. The outer tube has shorter longitudinal strips welded to its internal perimeter. The strips of the outer tube and the strips of the inner tube are constructed in such a way that they form a splined connection, which means that relative longitudinal movement is possible but relative rotation is restricted. In order to build up longitudinal force in between the two mating tubes, a friction has to be built up between their longitudinal strips; for this reason, kelly-bars of this type are called friction-kelly-bar.

Another version of the common kelly-bar is the locked-kelly-bar. In this version, the longitudinal welded steel strips of one of said tubes are provided with one or more notches, while the other is provided with one or more bosses, which are complementary to the notches, Once the notches are in line with the bosses, relative rotating of the tubes to one direction interlocks them together, in such a way that they allow longitudinal force to be delivered in between them both. Relative rotation to the other direction disengages the two tubes, and allows relative longitudinal movement in between them both.

The main disadvantage of the round tube-based kelly-bar is the large amount of welding, which is costly and time-consuming. Furthermore, the welding creates geometrical deformations and structural weaknesses.

As there must have been tolerance in between the tubes, they can, laterally, move, one inside the other. This degree of freedom reduces the straightness of the kelly-bar, and creates abrasion between the tubes.

The welded steel strips increase the weight of the kelly-bar.

There is a third type of kelly-bars based on square tubes, one inside the other, with large tolerance between them.

Each tube has two flanges. One flange at the top side, which covers the tolerance between the said tube and the tube surrounding it. This flange is connected to the said tube, and slides inside the outer tube. The second flange covers the tolerance between the said tube and the inner tube. This flange is connected to the said tube, and slides on the inner tube. As a result, the tubes constructing the kelly-bar have no contact between them. The only contact is between the tubes and the flanges. The tolerance between the flanges and the tubes, along the sliding path, is tight. Such a kelly-bar drives the rotary torque, from one tube to its adjusted tube, as much as the capacity of the tubes, but kelly-bars of this type have the problem that longitudinal force is limited to the maximum built up friction in between the tubes. As there must be tolerance in between the tubes and the flanges, they can laterally move, one inside the other. This degree of freedom reduces the straightness of the kelly-bar, and creates abrasion between the tubes while being in operation.

SUMMARY OF THE INVENTION

In drilling, it is obviously necessary to make a rotary movement with the drill tip, and subsequent Kelly-bars in a drill tool must be able to transfer torque. But it is also important that the drill tip is capable of exerting axial pressure; therefore, subsequent Kelly-bars in a drill tool must be able to transfer longitudinal force. Further, for a drill tool it is important that straightness is maintained during drilling.

Further, it would be desirable if the Kelly-bars have a simple design and can be manufactured efficiently.

A general objective of the present invention is to provide a relatively simple design for Kelly-bars with improved axial force transferring capabilities and with improved straightness.

A particular objective of the present invention is to provide a design for Kelly-bars in which no welded strips are needed to define interlocking splines.

A particular objective of the present invention is to provide a design for Kelly-bars in which, in use, the tubes are fully interlocked, have no lateral movement with respect to each other, and are centred with respect to each other.

According to the invention, successive tubes in a Kelly-bar have a free rotation position is which they are substantially free from each other in transverse direction, and an engaged rotation position, in which they contact each other according to a plurality of at least three longitudinal, substantially line-shaped contact zones that extend substantially the entire axial length where they overlap each other. In this engaged rotation position, torque transfer is possible. Further, high friction forces allow for high longitudinal force transfer. Further, the tubes support each other in transverse direction, preventing transversal displacement and enhancing straightness.

In a possible embodiment, interlocking coupling members may be provided, which engage in said engaged rotation position to further enhance longitudinal force transfer, and which disengage in said free rotation position to allow the tubes to be axially displaced with respect to each other telescopically.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, in which same reference numerals indicate same or similar parts, in which indications "below/above", "higher/lower", "left/right" "inner/outer", "top/bottom" etc. only relate to the orientation displayed in the drawings, and in which.

The bosses and the slots are not engaged.

Figure 7:
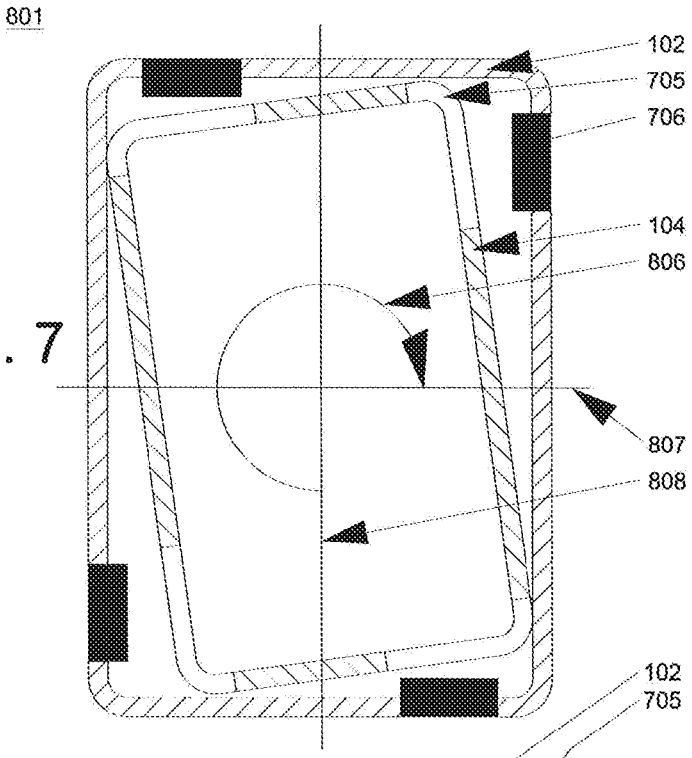

FIG. 7 shows a cross section through two rectangular tubes, being one inside the other. The inner tube has slots, and the outer tube has bosses protruding inwards. The outer tube has been rotated to an extreme clockwise position. The bosses and the slots are not engaged.

Figure 7A:
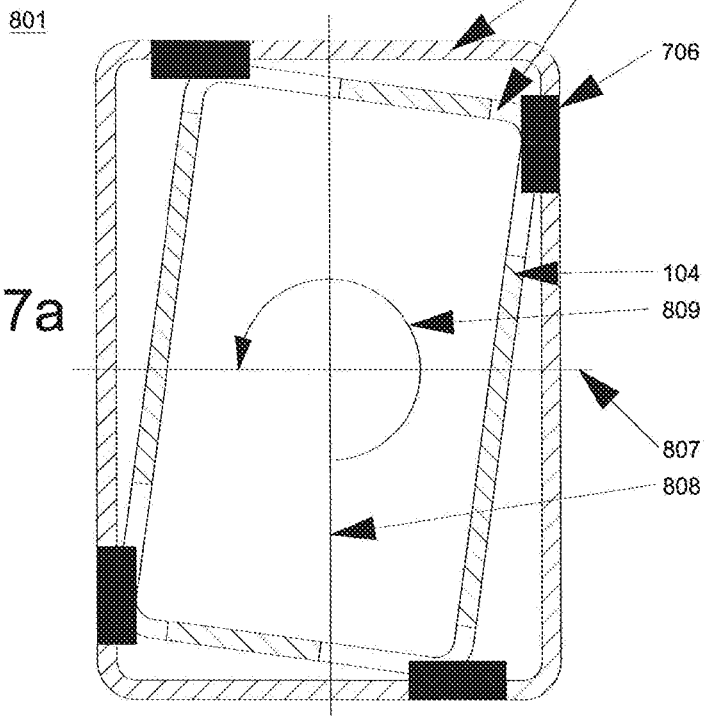

FIG. 7*a* shows a cross section through the same rectangular tubes as in FIG. 7, but now the outer tube has been rotated to an extreme counter-clockwise position. The bosses and the slots are engaged.

Figure 8:
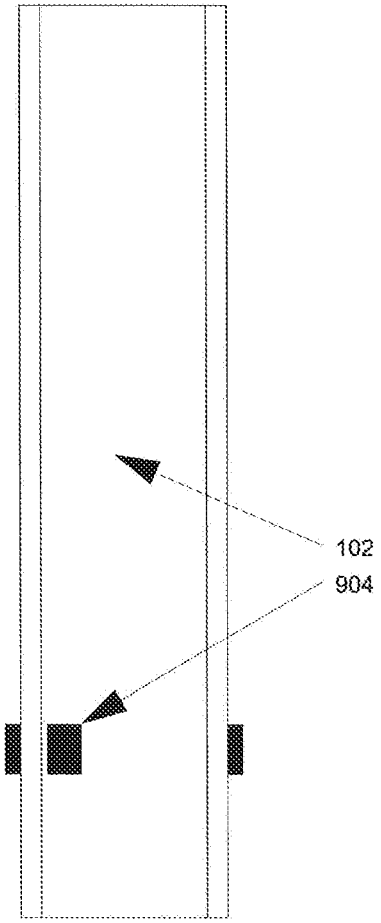

FIG. 8 shows a top view of an inner square tube having, four external bosses.

Figure 9:
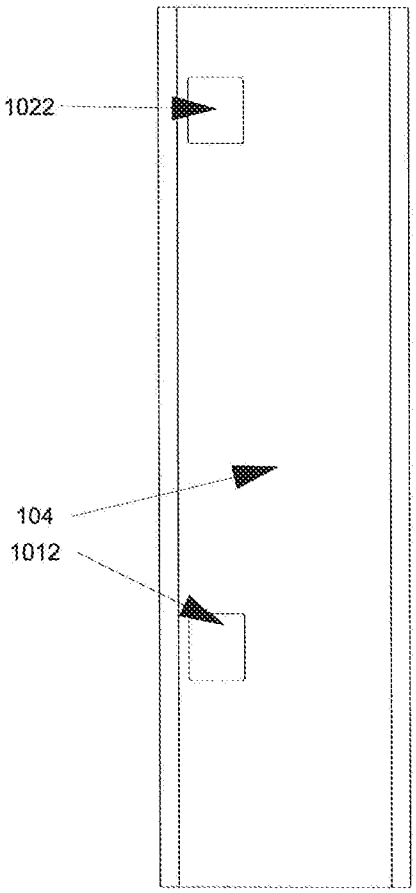

FIG. 9 shows a top view of an outer tube having two sets of four slots.

Figure 10B:
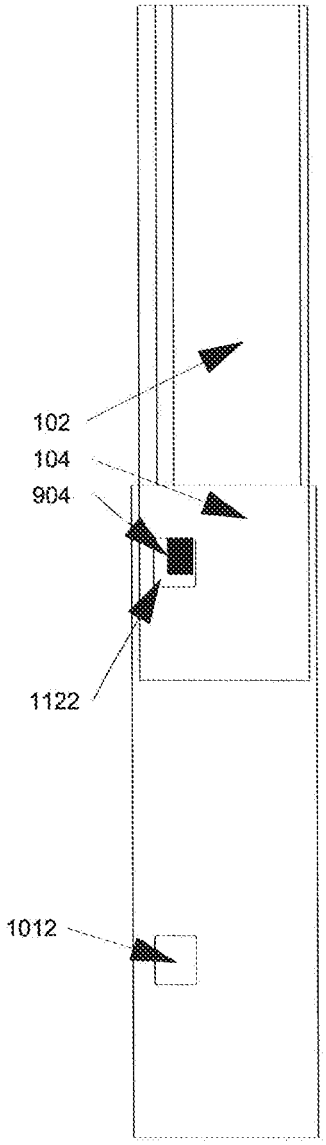
Figure 10A:
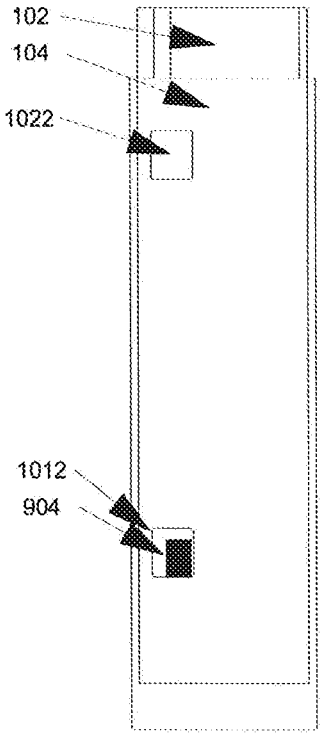

FIG. 10*a* shows the inner tube of FIG. 8 inside the outer tube of FIG. 9, while the bosses of the inner tube are engaged with the lower set of the slots of the outer tube.

FIG. 10*b* shows the inner tube of FIG. 8 inside the outer tube of FIG. 9, while the bosses of the inner tube are engaged with the upper set of the slots of the outer tube.

Figure 11:
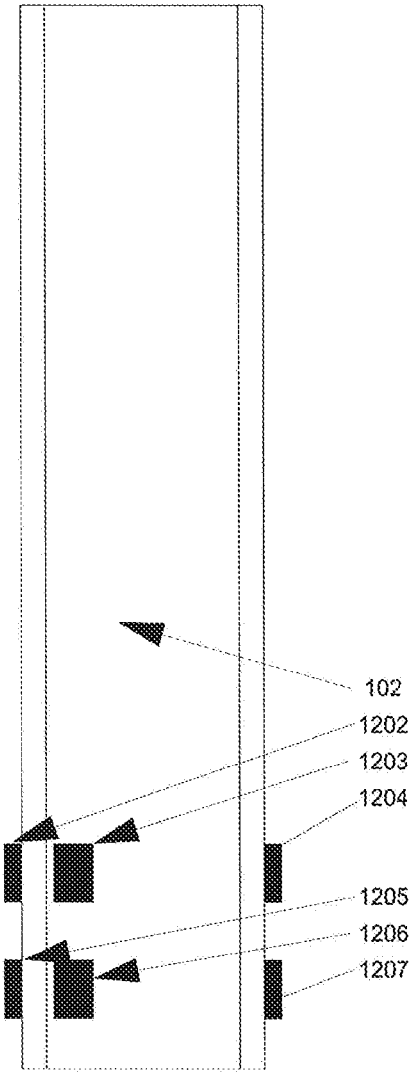

FIG. 11 shows a top view of an inner tube having two sets of bosses.

Figure 12:
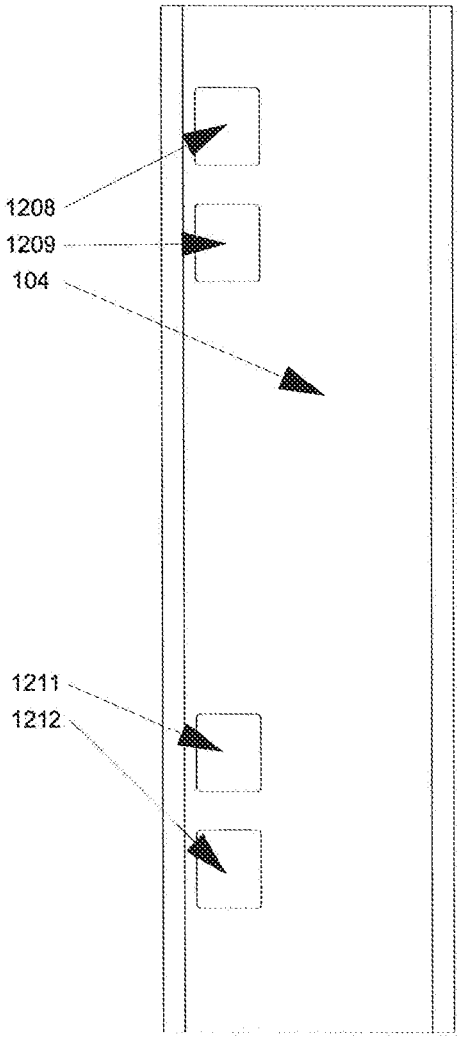

FIG. 12 shows a top view of an outer tube having two sets of slots in the lower part, and two sets of slots in the upper part.

Figure 13:
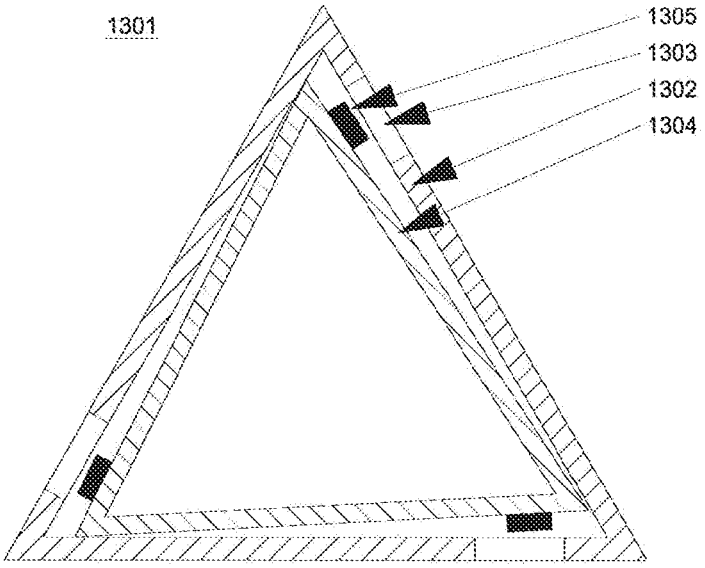

FIG. 13 shows a cross section of two triangular tubes, one inside the other. The inner tube has bosses, and the outer tube has slots.

Figure 14:
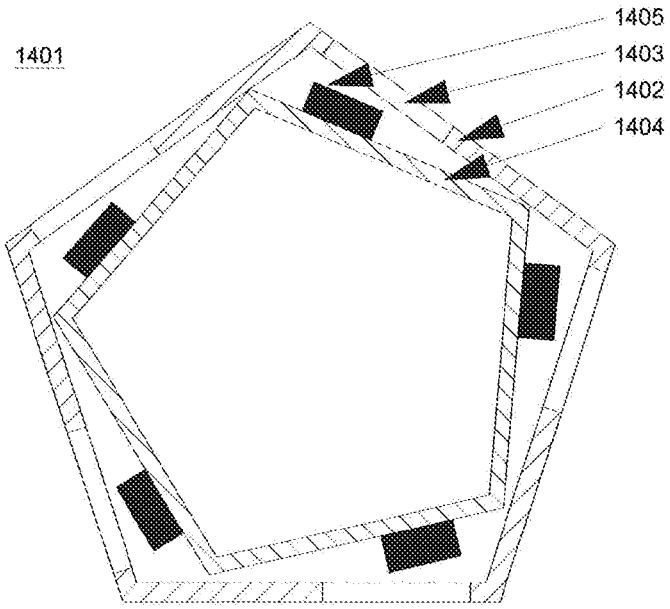

FIG. 14 shows a cross section of two pentagonal tubes, one inside the other. The inner tube has bosses, and the outer tube has slots.

Figure 15:
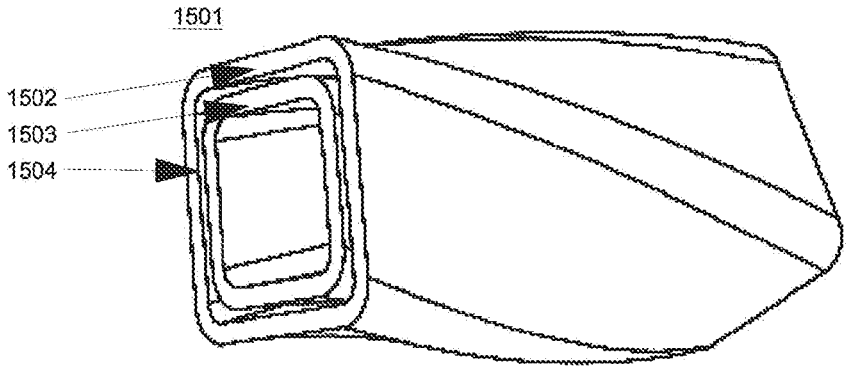

FIG. 15 shows a three-dimensional view of two square tubes, one inside the other, which are twisted along their longitudinal axis.

DETAILED DESCRIPTION OF THE INVENTION

Figure 1:
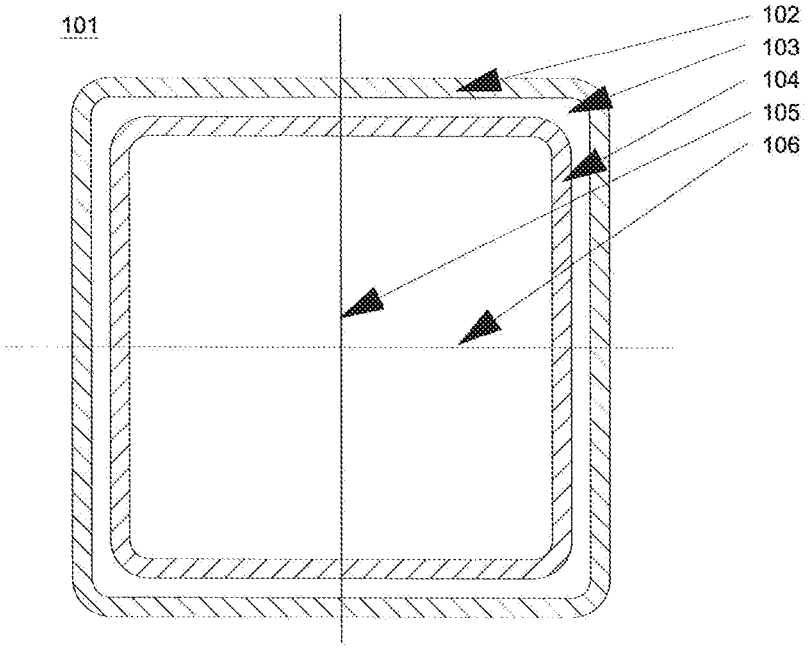
FIG. 1 shows a cross section through two square tubes, being one inside the other, and having large tolerance in between them both.

FIG. 1 shows a cross section through a tubular drive assembly 101 comprising two square tubes arranged co-axially within each other, Reference numeral 102 indicates the outer tube while reference numeral 104 indicates the inner tube. Reference numeral 105 indicates a vertical plane of symmetry, while reference numeral 106 indicates a horizontal plane of symmetry.

The inner relevant dimensions of the outer tube 102 are bigger than the outer correlated dimensions of the inner tube 104, so that an annular space 103 is defined between the two tubes, which will also be indicated as "tolerance". This tolerance is relatively large, allowing the two tubes to be rotated with respect to each other over a relatively large angle before the tubes contact each other and further relative rotation is prevented. This angle will hereinafter be indicated as contact angle.

Starting from the symmetric orientation of FIG. 1, the tubes can be rotated with respect to each other in either direction before touching each other. Stated differently, the tubes have rotational freedom with respect to each other over an angular range, the ends of that range being defined by the tubes contacting each other. This angular range will be indicated hereinafter as "rotational freedom range". In the example of FIG. 1, the angular extent of the rotational freedom range equals the contact angle times two.

Figure 2:
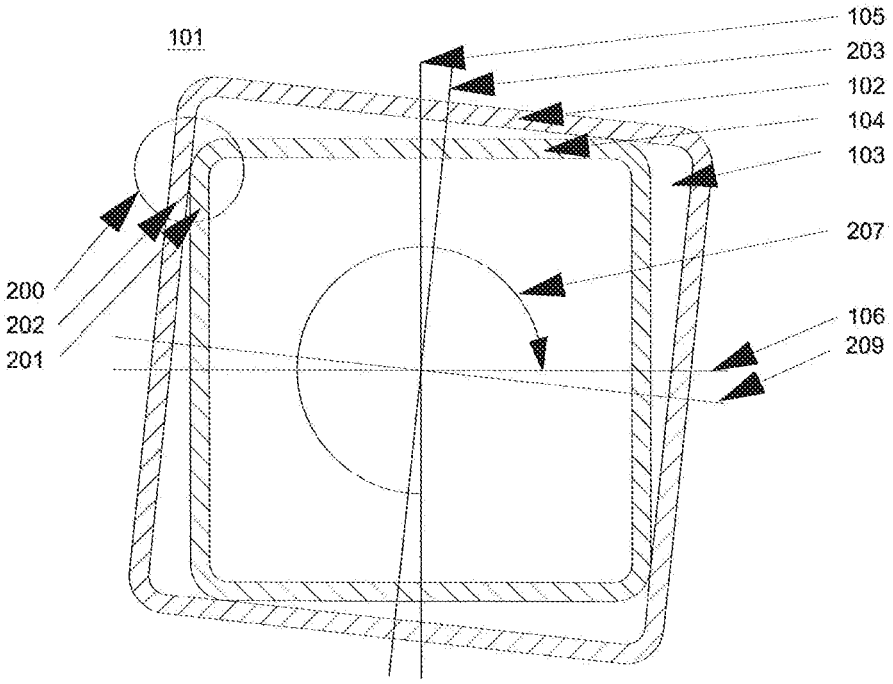
FIG. 2 shows a cross section through the same two square tubes as in FIG. 1, after the outer one has rotated clockwise, the maximum available.

FIG. 2 shows a cross section through the same tubular drive assembly 101 in a situation where the outer square tube 102 has been rotated with respect to the inner tube 104, about the longitudinal axis, in the direction indicated by arrow 207, over the said contact angle, so that the outer tube 102 and inner tube 104 touch each other at four positions. It is noted that these contact positions are POINTS in the cross section of FIG. 2 but will in reality be in principle four contact LINES. Reference numerals 203 and 209 indicate the two planes of symmetry of the outer tube 102, which will be indicated as displaced vertical plane of symmetry and displaced horizontal plane of symmetry, respectively.

In the relative position as shown in FIG. 2, the tubes 102, 104 are coupled for unidirectional torque and omnidirectional lateral forces. It will easily be seen that the outer square tube 102 can transfer to the inner square tube 104 torque in the direction of arrow 207, and that these tubes are interlocked for omnidirectional lateral forces as well; there is no way for lateral movement in between them.

It is further noted that, thanks to friction, the two tubes can transfer longitudinal force. This force transfer capability will be higher as the tubes are pressed together more firmly. During operation, when torque is exerted, the friction will be proportional to the torque. Also, the friction may depend on the contact angle.

It is further noted that the tubes, for as far as they overlap each other in axial direction, support each other firmly along said contact lines. As a consequence, they maintain their straightness very well.

It is noted that the horizontal symmetric plane 106 of the inner square tube, the horizontal symmetric plane 209 of the outer square tube, the vertical symmetric plane 105 of the inner square tube, and the vertical symmetric plane 203 of the outer square tube intersect each other in one line. The longitudinal centre lines of the outer square tube 102 and the inner square tube 104 coincide. The space 103 between the tubes, which in the position shown in FIG. 1 has an annular cross-section of uniform thickness, in the position shown in FIG. 2 consists of four separate voids having substantially triangular cross section.

While FIGS. 1 and 2 show a tubular drive assembly of two tubes, it is noted that the innermost tube does not have to be conformal with the outer tube. Instead of a tube, it may for instance be implemented as a solid bar, or as a combination of two or more components, as will be discussed with reference to FIG. 3.

The cross-sectional shape may differ from square; it may for instance be rectangular, as will be shown with reference to FIG. 7, it may for instance be triangular, as will be shown with reference to FIG. 13, it may for instance be pentagonal, as will be shown with reference to FIG. 14. Although not illustrated, it may also be for instance hexagonal, octagonal, more generally polygonal, or non-symmetric polygonal, having, or not having, equal edges, with, or without, curved edge(s).

Although it is preferred that the outer shape of the inner tube is conformal to the inner shape of the outer tube, the cross-sectional shape of the inner tube may differ from the cross-sectional shape of the outer tube. By way of example, an outer tube with square contour in combination with an inner tube having octagonal contour or cross-shaped contour is possible. The best torque-transferring capabilities are however obtained with conformal shapes.

A Kelly-bar can comprise more than two tubes arranged within each other, as will be discussed with reference to FIGS. 3 and 4.

Figure 3:
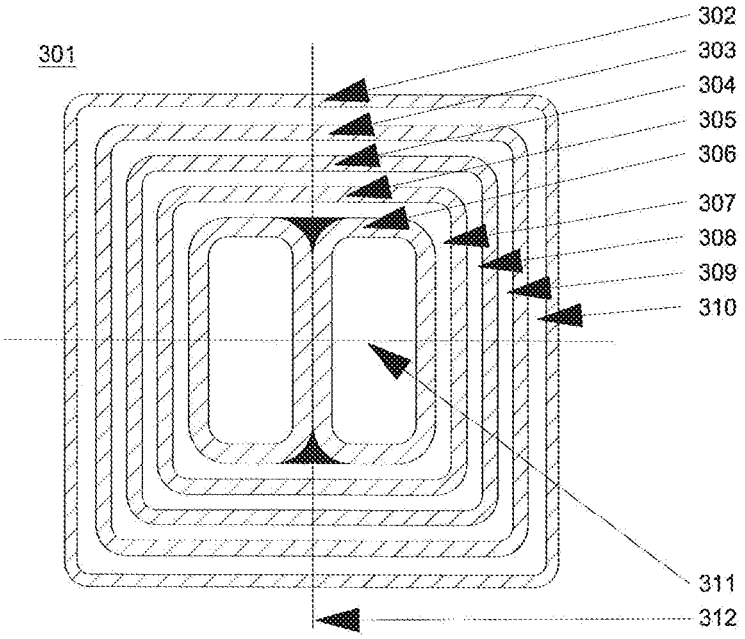
FIG. 3 shows a cross section through five square tubes, being one inside the other, and having large tolerance in between them all. The innermost square tube is built up from two rectangular tubes.

Comparable to FIG. 1, FIG. 3 shows a cross-section through a tubular drive assembly 301 of five square tubes 302, 303, 304, 305, and 306, one inside the other. The innermost tube 306 is built up from two rectangular tubes. There are large tolerances 307, 308, 309, and 310 in between the said tubes. In the position shown, the tubes are symmetrically aligned coaxially, so that the said tolerances are equally spread. Reference numeral 311 indicates a horizontal plane of symmetry, while reference numeral 312 indicates a vertical plane of symmetry.

Figure 4:
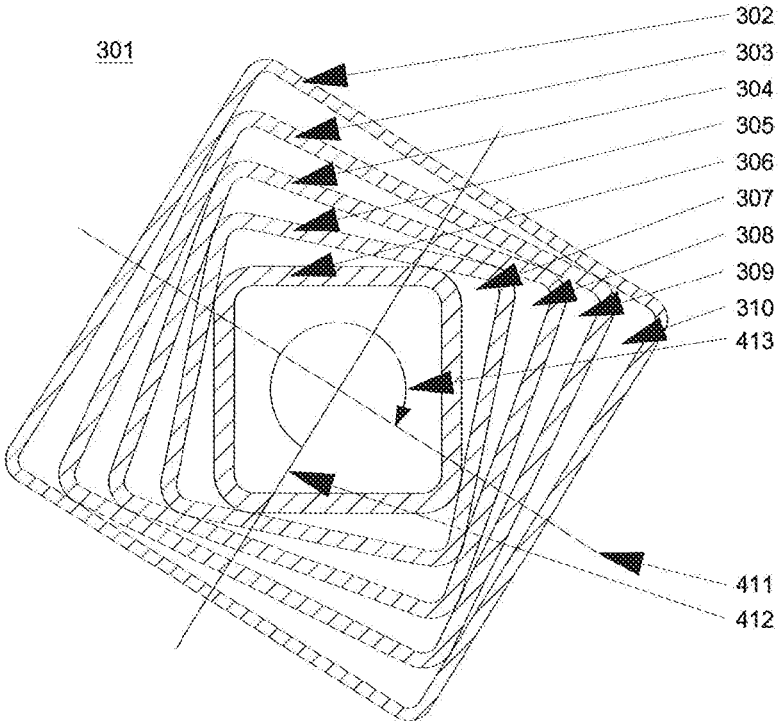
FIG. 4 shows a cross section through a similar arrangement of square tubes as in FIG. 3, after rotating them all (except the innermost tube) clockwise with respect to the innermost tube, to the maximum available. The innermost tube is a one-piece square tube.

In the cross-section of FIG. 4, the innermost tube 306 is a single square tube embodiment.

It is noted that each pair of two successive tubes always forms an arrangement similar to assembly 101, one tube always being the "inner" tube and the other being the "outer" tube. For each such pair there is a respective contact angle, as defined with reference to tubular drive assembly 101. Comparable to FIG. 2, FIG. 4 shows the tubular drive assembly 301 in a position where, in each pair of tubes, the outer tube has been rotated over the contact angle with respect to the corresponding inner tube, in the direction indicated by arrow 413. The rotated planes of symmetry of the outermost tube 302 are indicated by reference numerals 411, 412.

For each such pair of tubes, the same applies as what has been described with reference to FIGS. 1 and 2. As result, in this rotated position of FIG. 4, via the intermediary of the tubes in between, the outermost tube 302 can transfer torque in the direction of arrow 413, and omnidirectional lateral forces to the innermost tube 306, and vice versa, the innermost tube 306 can transfer torque in the opposite direction, and lateral forces, to the outermost tube 302.

It is noted that the five tubes shown by FIG. 4 302, 303, 304, 305, and 306 are centred, and all their vertical, and horizontal, plans of symmetry, have one, single, common, intersection line.

If the torque applied on tube 302 would have been to the opposite direction of arrow 413, then the relative positions of tubes 302, 303, 304, and 305 would have been a mirror view of FIG. 4—but the lateral lock in between all the tubes, the centralizing of all the tubes, and the torque delivery capacity would have been the same as described for torque applied to the direction of arrow 413. A similar remark applies to the friction, and the capacity to transfer longitudinal forces based on friction.

The above-described examples, illustrated with reference to FIGS. 1-4, relate to general possibilities for implementing Kelly-bar pairs. Summarized, there is always an outer tube and an inner body arranged within the outer tube, which inner body itself may also be a tube, which outer tube and inner body have limited rotational freedom with respect to each other, defined by and restricted by their respective contours and sizes. In a tubular drive assembly, there may be three, four, five, six, seven, eight or even more tubes, wherein always the next tube around the previous tube forms a Kelly-pair with that previous tube. Each pair has a disengaged position in which the two components do not interact, and an engaged position in which the two components provide for torque coupling and lateral coupling, which in any case means that the outer relevant dimensions of the inner body are smaller than the correlated inner dimensions of the outer body. Transition from the disengaged position to the engaged position is performed by relative rotation of the two tubes in one direction, and disengagement is achieved by rotation in the opposite direction. In embodiments of the tubular drive assemblies in accordance with the present invention which are provided with rotationally engaged/disengaged coupling members of male/female type, torque, centring and lateral coupling is provided as described above, but also form-closed coupling in longitudinal direction is provided to enhance longitudinal force-transferring capability.

It is noted that it is possible that rotating one component of the Kelly-bar couple to one direction will perform engaged coupling providing centring, lateral coupling, and friction based, or male/female, longitude force, but rotating the said tube to the opposite direction will not provide the same capacities as above. In other words, it is possible that the Kelly-bar couple behaviour is not symmetric to the two, opposite, rotation direction of one of the said couple.

Further more, the interaction lines between two engaged Kelly-bar tubes are along the relevant overlapping length of the said tubes, in contrast with the engagement of a tube and a flange of the other tube.

In some embodiments in accordance with the present invention, the components of a Kelly-pair (i.e. inner tube and outer tube) have mutually cooperating form-closing coupling members for longitudinal coupling. These form-closing coupling members are of male/female type. Coupling members of female type are implemented as an indent or opening in a tube; coupling members of male type are implemented as a protrusion. It is possible that the female coupling member is located at or in an inner tube of a Kelly-pair while the male coupling member is located at the inner side of the outer tube of that pair. It is possible that the female coupling member is located at or in an outer tube of a Kelly-pair while the male coupling member is located at the outer side of the inner tube. It is possible that a Kelly-pair has both of these possibilities implemented. It is noted, however, that making an opening in a tube is a step that can easily be performed from the outside, regardless of whether such opening is to be engaged from the inside or from the outside, and that making a protrusion from the outside is most easily performed on the outer side of such tube.

First, reference is made back to FIG. 2, illustrating the basic principle behind torque-coupling in a Kelly-pair, and showing the two tubes 102 and 104 in their coupled position. Depending on the geometry of the Kelly-pairs, they will touch each other in at least three locations; in the case of the square geometry shown, the tubes touch each other in four locations. Such location will in general be indicated as a touch location 200; it has already been indicated that such touch location in principle has the shape of a longitudinal line. The touch location 200 involves the outer surface of a touch portion 201 of the inner tube 104 and the inner surface of a touch portion 202 of the outer tube 102. It will be understood that the touch portion 201 of the inner tube 104 is quite close to a corner portion of the square (or in general: polygonal) contour of the inner tube 104, mainly depending on the radius of the corner portion. It will further be understood that the touch portion 202 of the outer tube 102 is in the neighbourhood of but somewhat more remote from a corner portion of the outer tube 102, the distance mainly depending on the tolerance between the tubes and consequently the contact angle.

Figure 5:
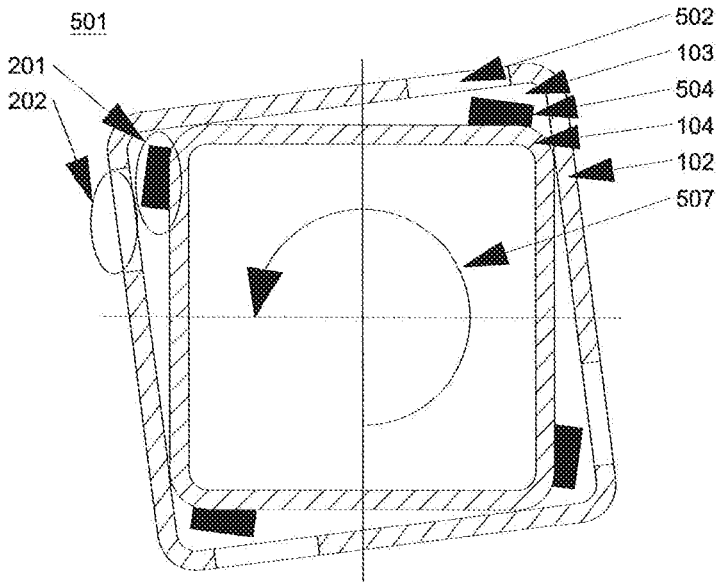
FIG. 5 shows a cross section through two square tubes, being one inside the other. The inner tube has bosses protruding outwards, and the outer tube has slots. The outer tube has been rotated to an extreme counter-clockwise position. The bosses and the slots are not engaged.

FIG. 5 shows a cross section through a tubular drive assembly 501, which is identical to assembly 101 of FIGS. 1 and 2, in that it comprises two square tubes 102 and 104, one inside the other, with large tolerance in between them. In addition, each touch portion 201, or next to the said touch portion, of the inner tube 104 is provided with a corresponding boss 504 protruding from its outer surface, and each touch portion 202, or next to the said touch portion, of the outer tube 102 is provided with an opening or slot 502. Thus, in this embodiment, outer tube 102 has four slots 502 and inner tube 104 has four bosses 504.

FIG. 5 shows the tubular drive assembly 501 in a position in which the outer tube 102 has been rotated counter clockwise with respect to the inner tube 104 as much as possible, as indicated by arrow 507. In this position, each boss 504 is withdrawn in a respective one of the voids 103. In this position, the tubes can transfer torque in one direction, and omnidirectional lateral forces, but in longitudinal direction the bosses and slots are not locked, therefore this position will be indicated as unlocked position. This relative rotational position of tubes 102, 104 allows free relative longitudinal movement between these tubes as long as no torque is exerted and therefore the longitudinal friction is absent or low.

It is noted that in the position shown by FIG. 5 while applying counter-clockwise torque, direction arrow 507, on the outer tube 102, the Kelly-pair 501 will deliver the torque, longitudinal force as built up by the friction, while maintaining straightness, centralizing, and lateral stiffness.

Figure 5A:
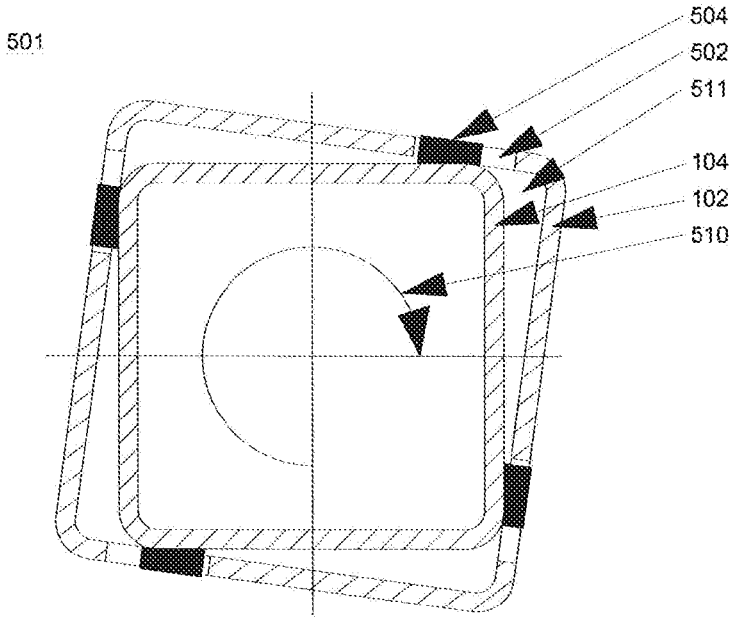
FIG. 5*a* shows a cross section through the same square tubes as in FIG. 5, but now the outer tube has been rotated to an extreme clockwise position. The bosses and the slots are engaged.

FIG. 5*a* shows the tubular drive assembly 501 in a position in which the outer tube 102 has been rotated as much as possible in the opposite direction, as indicated by arrow 510. In this position, each boss 504 has entered an associated one of the slots 502. Each boss 504 has a longitudinal extent, and each slot 502 has a longitudinal extent sufficiently larger to accommodate the corresponding boss 504, but the edges of each slot form a stop in longitudinal direction for the corresponding boss 504, thus limiting the longitudinal freedom of displacement of the boss and, consequently, of the entire inner tube 104 with respect to the outer tube. In fact, the longitudinal freedom of mutual displacement of the tubes is equal to the difference between the longitudinal extent of the slots and the longitudinal extent of the bosses, if there is no other part(s) limiting the longitudinal freedom of mutual displacement between the said tubes.

In this position, the tubes can transfer torque in one direction, as well as omnidirectional lateral forces, while further in longitudinal direction the tubes are locked, therefore this position will be indicated as locked position. The tubes 102, 104 are centred with respect to each other, and locked for lateral movements, for longitudinal forces, and for rotation in the direction of arrow 510. Even if no torque is exerted and friction is absent or low, longitudinal forces can be transferred.

It is noted that the cross-sectional view of FIGS. 5 and 5*a* shows each boss/slot, suggesting that the bosses 504 all have the same longitudinal position with respect to the inner tube 104 and that the slots 502 all have the same longitudinal position with respect to the outer tube 102, This is however not essential. Bosses may be staggered with respect to each other, and the same applies to slots. The only important issue is that the inner tube 104 has a longitudinal position with respect to the outer tube 102 in which the bosses are longitudinally aligned with the slots. The same applies to the width of the bosses 504.

Figure 6:
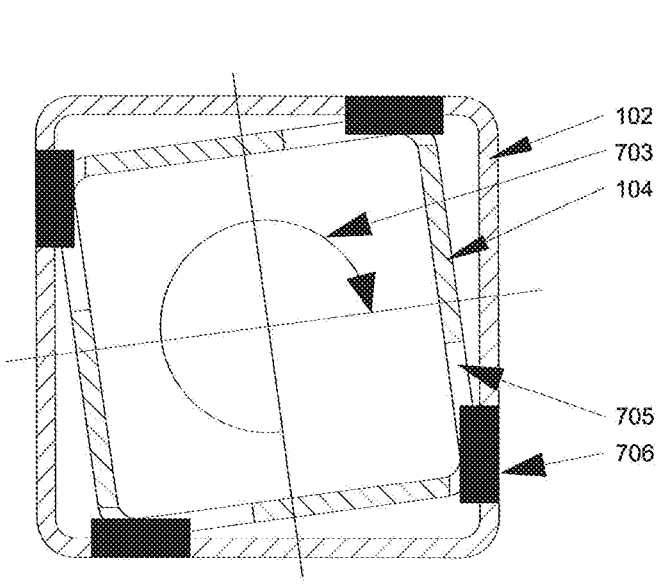
FIG. 6 shows a cross section through two square tubes, being one inside the other. The inner tube has slots, and the outer tube has bosses protruding inwards. The outer tube has been rotated to an extreme clockwise position. The bosses and the slots are engaged.
Figure 6A:
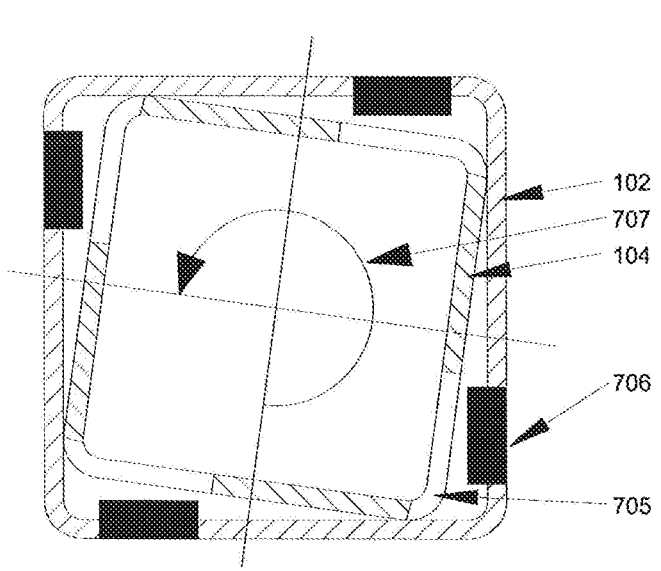
FIG. 6*a* shows a cross section through the same square tubes as in FIG. 6, but now the outer tube has been rotated to an extreme counter-clockwise position.

FIG. 6 shows a cross section through a tubular drive assembly 701, which is basically identical to the assembly 501 of FIG. 5, with the exception that the slots 705 are provided at the touch, or next to the touch, portions 201 of the inner tube 104 and that the bosses 706 are provided at the touch, or next to the touch, portions 202 of the outer tube 102. FIG. 6 shows the tubular drive assembly 701 in the locked position: the outer tube 102 has been rotated clockwise (arrow 703) to the contact position, and the bosses 706 have entered the corresponding slots 705. FIG. 6*a* shows the same assembly 701 in the unlocked position: the outer tube 102 has been rotated counter-clockwise (arrow 707) to the contact position, and the bosses 706 have withdrawn from the corresponding slots 705.

FIGS. 7 and 7*a* are cross-sections comparable to FIGS. 6*a* and 6, respectively, of a tubular drive 801, which is identical to the assembly 701 of FIGS. 6 and 6*a*, except that the cross-sectional contour of the tubes 102 and 104 is rectangular rather than square. The arrangement is mirrored with respect to the arrangement of FIGS. 6 and 6*a*, which is equivalent to a cross-sectional view in the opposite direction when the arrangement is identical. Thus, FIG. 7 shows the tubular drive assembly 801 in the unlocked position, with the outer tube 102 rotated clockwise (arrow 806) to the contact position, and FIG. 7*a* shows the tubular drive assembly 801 in the locked position, with the outer tube 102 rotated counter clockwise (arrow 809) to the contact position.

Applying the locking mechanism between two adjusted tubes, as described, as an example, in FIG. 5, and FIG. 5*a*, requires large tolerance in between the relevant tubes, as to allow dis-engagement, and longitudinal relative movement between them. The said tolerance is larger than common in machine design. The lower limit of said tolerance has to allow free longitudinal relative movement, like, as an example, shown in FIG. 5. The upper limit of said tolerance has to avoid free rotating of the inner tube inside the outer tube, and to avoid damage to each of the two tubes while designed torque is applied.

In the above, the locking of form-closing coupling members of male and female type has been described, with reference to one longitudinal position of the inner tube 104 and outer tube 102. FIG. 8 is a schematic top view of an inner tube 102, having outwardly projecting bosses 904 (compare FIG. 5) at a certain longitudinal position; only three bosses are visible in this view. FIG. 9 is a schematic top view of an outer tube 104, having a first series of slots 1012 at a first longitudinal position and having a second series of slots 1022 at a second longitudinal position (of each series of slots, only one slot is visible in this view).

With such arrangement, the tubes 102, 104 of this tubular drive assembly have two locked positions. In a first locked position, the bosses 904 engage the first series of slots 1012; FIG. 10*a* is a top view, similar to FIGS. 8 and 9, of this tubular drive assembly with the tubes 102, 104 in the first locked position. In a second locked position, the bosses 904 engage the second series of slots 1022, as illustrated in FIG. 10*b*.

A similar arrangement of multiple series of slots is also possible if the slots are in the inner tube while the outer tube has inwardly projecting bosses.

It has to be noted that in common Kelly-bar use, there are, mainly, two working situations—while the Kelly-bar is extracted, and while the Kelly-bar is shortened. FIG. 10*b* shows the extracted situation, while FIG. 10*a* shows the shortened situation. It is possible that in the shortened situation the male/female coupling serves just for geometric purposes—in order to allow lines engagement between the Kelly-bar couple in order to have them centered, and to let them have lateral, and rotational, strength, but not in order to increase their longitudinal force capacity.

In the above-described embodiments, the series of male-type coupling members always comprised one boss on each side surface of the polygonal shape, either outwardly projecting from an inner tube or inwardly projecting from an outer tube. This is, however, not essential.

It is not essential that each such side face is provided with an engagement boss, although this is preferred. In the above examples, if one boss (or more but not all bosses) would be omitted, the functioning would remain the same, although the longitudinal force-transmitting capacity would reduce.

On the other hand, it is possible that the series of male-type coupling members comprises two (or even more) bosses per side surface, in which case the number of slots would likewise increase. FIGS. 11 and 12 are views comparable to FIGS. 8 and 9. FIG. 11 shows an inner tube 102 having a series of outwardly projecting bosses, wherein each side surface always comprises a set of two bosses 1202, 1205; 1203, 1206; and 1204, 1207; only six bosses are visible in this top view. A set may have three or more bosses. FIG. 12 shows an outer tube 104 having two series of slots at different longitudinal positions. In each series, there is always a set of two openings per side surface. A first series of slots comprises a set of two slots 1211, 1212 at a first longitudinal position. A second series of slots comprises a set of two slots 1208, 1209 at a second longitudinal position. Only one side surface is visible in this view, hence only four slots are visible.

Two series of slots may have slots in common. For instance, imagine that the second series of slots were to be displaced towards the first series of slots, i.e. the second set of two slots 1208, 1209 would come closer to the first set of two slots 1211, 1212. Ata certain moment, slots 1209 and 1211 would coincide, and there would be three slots defining two locking positions.

In embodiments having two or more locking positions, an operation is possible in which the tubes are first locked in a first locking position, the tubes are rotated in one direction keeping the tubes locked, then rotation and associated torque-transfer is stopped, the tubes are rotated to the unlocked position, the tubes are axially displaced with respect to each other to reach a second locking position, and then the tubes are rotated in said one direction again to lock them again, while the drilling tool now has a different axial length.

The precise profile of the tubes is not essential, as the gist of the invention can be practiced with various types of tube profile. In the above, the invention has been explained and described for exemplary embodiments where the tubes are square or rectangular, but the tubes may also be irregular quadrangles.

The tubes may be triangular, regular or irregular. FIG. 13 is a cross section of a tubular drive assembly 1301 of triangular configuration, having an outer tube 1302 and an inner tube 1304. In the embodiment shown, the outer tube 1302 is provided with slots 1303 and the inner tube 1304 is provided with outwardly projecting bosses 1305. FIG. 13 shows the tubular drive assembly 1301 in the disengaged position. Since the operation is basically identical to the operation of the embodiments discussed above, as should be clear to a person skilled in the art, explanation of the operation is not repeated here.

The tubes may be of higher-order polygonal type, regular or irregular, such as for instance octagonal, hexagonal. FIG. 14 is a cross section of a tubular drive assembly 1401 of pentagonal configuration, having an outer tube 1402 and an inner tube 1404. In the embodiment shown, the outer tube 1402 is provided with slots 1403 and the inner tube 1404 is provided with outwardly projecting bosses 1405. FIG. 14 shows the tubular drive assembly 1401 in the disengaged position. Since the operation is basically identical to the operation of the embodiments discussed above, as should be clear to a person skilled in the art, explanation of the operation is not repeated here.

The tubes may even be of star-shaped configuration.

The tubes do not need to have an angular configuration; they may for instance be of corrugated configuration. What is important is that, described in polar coordinates r, φ, the radius r of a tube varies as a function of φ between a smallest value Rmin and a largest value Rmax. The largest value Rmax of the inner tube is larger than the smallest value Rmin of the outer tube, so that the two tubes have only limited rotational freedom with respect to each other. The tubes may be provided with mutually cooperating form-closing coupling members for longitudinal coupling. The rotational freedom is sufficiently large such that the two tubes have a first extreme rotational position in which the coupling members are free from each other, indicated as disengaged position, and a second extreme rotational position in which the coupling members are in engagement with each other, indicated as engaged position. The tubes can be made to engage each other for torque transfer by mutual rotation in either direction, although in practice only one direction will be used in operation. The coupling members of the tubes can be made to engage each other by mutual rotation of the tubes in one direction towards the second extreme rotational position, and can be made to disengage by mutual rotation in the opposite direction towards the first extreme rotational position.

In each one of the extreme rotational positions, the tubes are coupled for rotation in a single direction, depending on which tube is a driving tube and which tube is a driven tube. This single direction is opposite for the first extreme rotational position as compared to the second extreme rotational position. In the first extreme rotational position, the tubes are free to move longitudinally with respect to each other if no torque is exerted, but in the second extreme rotational position, the tubes are longitudinally interlocked firmly even if no torque is exerted. One tube can push or pull the other tube longitudinally. Whenever the tubes are in the first, or second, extreme rotational location, they are centered, coupled for single direction rotation operation, and coupled for omnidirectional lateral movements. The above centring, and couplings are done by, at least, three longitudinal contact lines, and along the complete overlapping length of the inner, and the outer, tubes.

It is possible to realize the engagement mechanism, as well as the interlocking mechanism, by variety of polygons, even by polygons with non-equal edges, and/or non-equal amount of edges, and/or with non-equal cross section width, or widths.

The tube(s) and rod may be twisted rather than straight. FIG. 15 shows a 3D drawing of Kelly-bar couple 1501, comprised of outer tube 1502, and inner tube 1503, having gape 1504 in between them both. Tubes 1502 and 1503 are twisted along their main longitudinal axis, and screwed one into the other. Apart from this twist, and the consequential helix-shape of longitudinal lines, the same description as above applies, and will not be repeated here.

The bosses of the relevant tubes may be produced by variety of ways, such as for instance but not exclusively: welding, soldering, riveting, and/or bolting parts to the tube, forging, bolts, cold, or hot, forming, and any combination of them. The bosses may be done from hardened, or hard, material, or may be covered by hard welding.

The slots of the relevant tubes may be produced by variety of ways, such as for instance but not exclusively: cutting, punching, forging, cold, or hot, forming, casting, sawing, grinding, welding piece with slot in it, or any combination of them. The slots may be thermally hardened, or covered by hard welding. It is possible to cut around the place for the slot, and to replace the removed piece by one with hard slot.

It should be clear to a person skilled in the art that the present invention is not limited to the exemplary embodiments discussed above, but that several variations and modifications are possible within the protective scope of the invention as defined in the appending claims. For instance, the bosses and/or the slots may have rounded and/or tapered shapes to facilitate engagement. Further, in the embodiments shown and discussed, any tube was either provided with slots or with bosses, but it is also possible to have an embodiment in which the outer tube is provided with inward bosses and the inner tube is provided with outward bosses, while the outer tube is provided with recesses or openings for the outward bosses of the inner tube and the inner tube is provided with recesses or openings for the inward bosses of the outer tube.

Further, while the embodiments shown in the figures are provided with rotationally engaged/disengaged coupling members of male/female type, it is to be noted that the invention also relates to embodiments without such coupling members, longitudinal force transfer only being based on friction.

Even if certain features are recited in different dependent claims, the present invention also relates to an embodiment comprising these features in common.

Even if certain features have been described in combination with each other, the present invention also relates to an embodiment in which one or more of these, features are omitted.

Features which have not been explicitly described as being essential may also be omitted. Any reference signs in a claim should not be construed as limiting the scope of that claim.

The invention claimed is:

1. A tubular drive assembly comprising:

an outer tube having a first longitudinal axis and a polygonal cross-sectional contour having side faces and corner areas; and an inner body having a second longitudinal axis, a polygonal cross-sectional contour having side faces and corner areas, and arranged within the outer tube;

wherein the inner body and the outer tube have a mutual axial overlap;

wherein the outer tube and the inner body have radial play so that the outer tube and the inner body have rotational freedom with respect to each other over an angular rotational freedom range between a first extreme rotational position and a second extreme rotational position; and wherein at least one of the extreme rotational positions is defined by outer surfaces of at least three corner areas of the inner body contacting inner surfaces of respective side faces of the outer tube in respective substantially line-shaped contact zones that extend axially over substantially the entire axial length of the overlap.

2. The tubular drive assembly according to claim 1, wherein in the at least one of the extreme rotational positions, torque transfer is possible and friction forces allow for longitudinal force transfer.

3. The tubular drive assembly according to claim 1, wherein in the at least one of the extreme rotational positions, the outer tube and the inner body support each other in transverse direction to prevent transversal displacement and to enhance straightness.

4. The tubular drive assembly according to claim 1, wherein both of the extreme rotational positions are defined by the outer surfaces of at least three corner areas of the inner body contacting the inner surfaces of respective side faces of the outer tube in respective substantially line-shaped contact zones.

5. The tubular drive assembly according to claim 1, wherein the outer tube and the inner body mutually have the same number of edges.

6. The tubular drive assembly according to claim 1, wherein the outer tube and the inner body are conformal.

7. The tubular drive assembly according to claim 1, wherein the outer tube and the inner body have a configuration selected from the group consisting of a rectangular configuration, a square configuration, a triangular configuration, a pentangular configuration, a hexangular configuration, and an octangular configuration.

8. The tubular drive assembly according to claim 1, wherein the number of line-shaped contact zones is at least three.

9. The tubular drive assembly according to claim 1, wherein the outer tube and the inner body are provided with mutually cooperating coupling members for providing mutual fixation in longitudinal direction;

wherein the mutually cooperating coupling members comprise at least one boss and at least one corresponding recess or opening capable of receiving the boss;

wherein the at least one boss is selected from the group consisting of:

a first boss protruding inward from an inner surface of one of the side faces of the outer tube;

a second boss protruding outward from an outer surface of the inner body; and a combination thereof;

wherein the at least one corresponding recess or opening is selected from the group consisting of:

a first recess or opening arranged at the outer surface of the inner body, each first recess or opening capable of receiving a first boss;

a second recess or opening arranged at the inner surface of one of the side faces of the outer tube, each second recess or opening capable of receiving a second boss; and a combination thereof; and wherein each boss and the corresponding recess or opening are arranged at or near the contact zones such that they are engageable by mutual rotation of the outer tube and the inner body in a first direction and are dis-engageable by mutual rotation of the outer tube and the inner body in a second direction opposite the first direction.

10. The tubular drive assembly according to claim 9, wherein one extreme rotational position is a locked position in which the coupling members are interlocked; and wherein the other extreme rotational position is an unlocked position in which the coupling members are unlocked.

11. The tubular drive assembly according to claim 9, wherein the coupling members are form-closing coupling members.

12. The tubular drive assembly according to claim 9, comprising two or more sets of coupling members arranged at the same longitudinal position.

13. The tubular drive assembly according to claim 9, comprising two or more sets of coupling members arranged at different longitudinal positions.

14. The tubular drive assembly according to claim 9, comprising two or more sets of coupling members arranged at mutual longitudinal distance.

15. The tubular drive assembly according to claim 9, having a first locked condition at a first longitudinal position and a second locked condition at a second longitudinal position.

16. The tubular drive assembly according to claim 9, wherein a total number of the at least one recess or opening is equal to or larger than a total number of the at least one boss.

17. The tubular drive assembly according to claim 1, wherein the outer tube and the inner body are twisted along their main longitudinal axis.

18. An arrangement of an inner body and two or more tubes arranged coaxially around each other, wherein each pair of two successive tubes forms the tubular drive assembly according to claim 1.

19. A drilling tool comprising a tubular drive assembly according to claim 1.

20. A tubular drive assembly comprising:

an outer tube having a first longitudinal axis; and an inner body having a second longitudinal axis arranged within the outer tube;

wherein the outer tube and the inner body are twisted along their main longitudinal axis;

wherein the outer tube and the inner body have rotational freedom with respect to each other over an angular rotational freedom range between a first extreme rotational position and a second extreme rotational position; and wherein at least one of the extreme rotational positions is an engagement position in which the outer tube and the inner body contact each other according to a plurality of at least three longitudinal, substantially line-shaped contact zones.

21. A tubular drive assembly comprising:

an outer tube having a first longitudinal axis and one or more coupling members; and an inner body having a second longitudinal axis and one or more coupling members, the inner body being arranged within the outer tube;

wherein the inner body and the outer tube have a mutual axial overlap;

wherein the coupling members of the outer tube and the inner body are mutually cooperating coupling members for providing mutual fixation in longitudinal direction;

wherein the outer tube and the inner body have rotational freedom with respect to each other over an angular rotational freedom range between a first extreme rotational position and a second extreme rotational position;

wherein at least one of the extreme rotational positions is an engagement position in which the outer tube and the inner body contact each other according to a plurality of at least three longitudinal, substantially line-shaped contact zones that extend axially over substantially the entire axial length of the overlap;

wherein the mutually cooperating coupling members comprise at least one boss and at least one corresponding recess or opening capable of receiving the boss;

wherein the at least one boss is selected from the group consisting of:

a first boss protruding inward from an inner surface of one of the side faces of the outer tube;

a second boss protruding outward from an outer surface of the inner body; and a combination thereof;

wherein the at least one corresponding recess or opening is selected from the group consisting of:

a first recess or opening arranged at the outer surface of the inner body, each first recess or opening capable of receiving a first boss;

a second recess or opening arranged at the inner surface of one of the side faces of the outer tube, each second recess or opening capable of receiving a second boss; and a combination thereof; and wherein each boss and the corresponding recess or opening are arranged at or near the contact zones such that they are:

engageable by mutual rotation of the outer tube and the inner body in a first direction; and dis-engageable by mutual rotation of the outer tube and the inner body in a second direction opposite the first direction.

22. The tubular drive assembly according to claim 21, wherein a total number of the at least one recess or opening is equal to or larger than a total number of the at least one boss.

* * * * *